US009000315B2

(12) United States Patent
Baum et al.

(10) Patent No.: US 9,000,315 B2
(45) Date of Patent: Apr. 7, 2015

(54) WATERPROOF SWITCH HAVING UNIFORM TACTILE FEEL

(75) Inventors: Matthew R. Baum, Batesville, IN (US); James P. Meagher, Indianapolis, IN (US); Zhen Li, Shenzhen (CN); Charles V. Edwards, Nashville, IN (US)

(73) Assignee: Nidec Motor Corporation, St. Louis, MO (US)

( * ) Notice: Subject to any disclaimer, the term of this patent is extended or adjusted under 35 U.S.C. 154(b) by 228 days.

(21) Appl. No.: 13/483,767

(22) Filed: May 30, 2012

(65) Prior Publication Data

US 2013/0292235 A1 Nov. 7, 2013

(30) Foreign Application Priority Data

May 3, 2012 (CN) ..... 2012 1 0135581

(51) Int. Cl.

| | |
|---|---|
| ***H01H 13/06*** | (2006.01) |
| ***H01H 13/50*** | (2006.01) |
| ***H01H 13/14*** | (2006.01) |
| ***H01H 9/04*** | (2006.01) |
| ***H01H 3/12*** | (2006.01) |
| ***H01H 13/86*** | (2006.01) |

(52) U.S. Cl.

CPC ..... *H01H 13/06* (2013.01); *H01H 13/50* (2013.01); *H01H 13/14* (2013.01); *H01H 9/04* (2013.01); *H01H 3/122* (2013.01); *H01H 13/86* (2013.01); *H01H 2009/048* (2013.01); *H01H 2229/00* (2013.01)

(58) Field of Classification Search

CPC ..... H01H 13/06; H01H 13/50; H01H 13/14; H01H 9/04

USPC ..... 200/302.2, 302.1, 344, 517

See application file for complete search history.

(56) References Cited

U.S. PATENT DOCUMENTS

| | | | | | |
|---|---|---|---|---|---|
| 5,424,516 | A * | 6/1995 | Emmons | 200/344 |
| 5,597,067 | A * | 1/1997 | Yoneyama | 200/344 |
| 5,669,723 | A * | 9/1997 | Chang | 400/496 |
| 5,823,325 | A * | 10/1998 | Lin | 200/344 |
| 6,057,522 | A * | 5/2000 | Chao | 200/344 |
| 6,100,482 | A * | 8/2000 | Koma et al. | 200/344 |
| 6,137,071 | A * | 10/2000 | Yeh et al. | 200/344 |
| 6,965,085 | B1 * | 11/2005 | Orrico et al. | 200/314 |
| 7,064,287 | B2 * | 6/2006 | Kameda | 200/341 |
| 7,829,803 | B2 * | 11/2010 | Babella | 200/5 A |

* cited by examiner

*Primary Examiner* — Kyung Lee

(74) *Attorney, Agent, or Firm* — Hovey Williams LLP

(57) ABSTRACT

A manually operated switch assembly is disclosed. The switch assembly includes a housing, a switch mechanism, and an actuator assembly. The switch mechanism is housed within the housing and is configured to open or close a circuit upon actuation. The actuator assembly is shiftably supported by the housing and generally includes a depressible actuator and a stability element. The actuator presents an actuator length and serves to actuate the switch mechanism when depressed. The stability element is configured to ensure that the actuator moves substantially uniformly along the actuator length when the actuator is depressed such that actuation of the switch mechanism is facilitated regardless of where the actuator is depressed along the actuator length. The switch assembly may be waterproofed, and be formed, at least in part, by a curable liquid sealant supplied to the switch assembly from a single fluid source.

11 Claims, 11 Drawing Sheets

WATERPROOF SWITCH HAVING UNIFORM TACTILE FEEL

BACKGROUND OF THE INVENTION

1. Field of the Invention

The present invention relates generally to electrical switch assemblies. More specifically, the present invention concerns a preferably waterproof switch having a uniform tactile feel.

2. Discussion of Prior Art

Those ordinarily skilled in the user actuatable switch assembly art will appreciate the broad utility of user depressible switch assemblies with one example of such assemblies being touchpad switch assemblies commonly used in the automotive industry. Notably, a user actuates such touchpad switch assemblies by depressing the touchpad a predetermined distance to engage a tact switch, elastomeric or metal dome switch, or the like. The switch is operably part of the final switch assembly and provides a tactile feel depending on the configuration and design of the switch. Importantly, a uniform tactile feel across the entire touchpad area is desired. Such uniformity may be difficult to obtain, however, because standard touchpad applications are sufficiently dimensioned to ensure actuation. In some instances, touchpad switch assemblies are configured to be operated by a plurality of fingers, such as, for instance, three fingers.

However, conventional large touchpad applications are problematic. For instance, if the assembly is provided with a single switch, actuation of the switch is not assured, particularly when one end of the touchpad is pressed by the user. With prior art switch assembly designs, the touchpad (or underlying actuator) can become canted or otherwise simply fail to actuate the switch. Furthermore, uneven movement of the shiftable portion of the switch assembly provides the user with unreliable tactile feedback as to whether the switch assembly has been actuated. Some conventional switch assemblies are provided with multiple switches spaced along the touchpad. However, this design requires signal debouncing when more than one of the switches is actuated by the user.

Moreover, as a result of the broad utility of user depressible switch assemblies, switch assemblies are exposed to, and must preferably withstand, a broad array of environmental and weather conditions. For instance, automotive touchpads experience large temperature ranges, rain, snow, and high-pressure car washes, thus requiring touchpads to be reliably sealed by employing various manufacturing techniques to protect the switch from such conditions, which may deteriorate and/or compromise the performance or functionality of the switch assembly. Sealing techniques are therefore preferable to protect the switch assembly and may be achieved by rubber and/or plastic over-molded parts, seal beading techniques, liquid adhesives, room temperature vulcanization techniques, epoxies, and the like. Application of such sealing techniques can, however, present manufacturing difficulties. For instance, reliable and repeatable sealing with epoxy presents challenges of consistently applying the epoxy in the desired sealing locations without presenting air bubbles and other voids that potentially denigrate the quality of the desired seal. Moreover, improved application of sealant commonly requires a moving applicator to appropriately seal various locations spaced apart on the switch assembly. But dynamic or moving sealant applicators introduce reliability and/or efficiency difficulties in the manufacturing process, which, again, may deteriorate and/or compromise the performance or functionality of the seal and, therefore, the switch assembly.

SUMMARY OF THE INVENTION

Responsive to these and other problems, an important object of the present invention is to provide a preferably waterproof switch having a uniform tactile feel.

According to a first aspect of the present invention, a manually operated switch assembly broadly includes a housing, a switch mechanism, and an actuator assembly. The switch mechanism is housed within the housing and is configured to open or close a circuit upon actuation. The actuator assembly is shiftably supported by the housing and generally includes a depressible actuator and a stability element. The depressible actuator is configured to be manually depressed when the switch assembly is operated. The actuator presents an actuator length and serves to actuate the switch mechanism when depressed. The stability element is configured to ensure that the actuator moves substantially uniformly along the actuator length when the actuator is depressed such that actuation of the switch mechanism is facilitated regardless of where the actuator is depressed along the actuator length.

Another aspect of the present invention concerns a waterproof manually operated switch assembly formed at least in part by a curable liquid sealant supplied to the switch assembly from a single sealant source. The waterproof switch assembly broadly includes a switch mechanism, and a housing. The switch mechanism is housed within the housing and configured to open or close a circuit upon actuation. The housing presents first and second openings. The first opening is configured to receive liquid sealant from the sealant source. The second opening is spaced from the first opening. A sealant transfer channel is defined by the housing and extends between the first and second openings to define a liquid sealant flow path between the first and second openings. The liquid sealant supplied to the first opening flows along the transfer channel into the second opening. Thus, the first and second openings contain cured sealant, with the sealant in the second opening having been supplied from the first opening.

Other aspects and advantages of the present invention will be apparent from the following detailed description of the preferred embodiments and the accompanying drawing figures.

This summary is provided to introduce a selection of concepts in a simplified form that are further described below in the detailed description of the preferred embodiments. This summary is not intended to identify key features or essential features of the claimed subject matter, nor is it intended to be used to limit the scope of the claimed subject matter.

BRIEF DESCRIPTION OF THE DRAWING FIGURES

Preferred embodiments of the invention are described in detail below with reference to the attached drawing figures, wherein.

Figure 1:
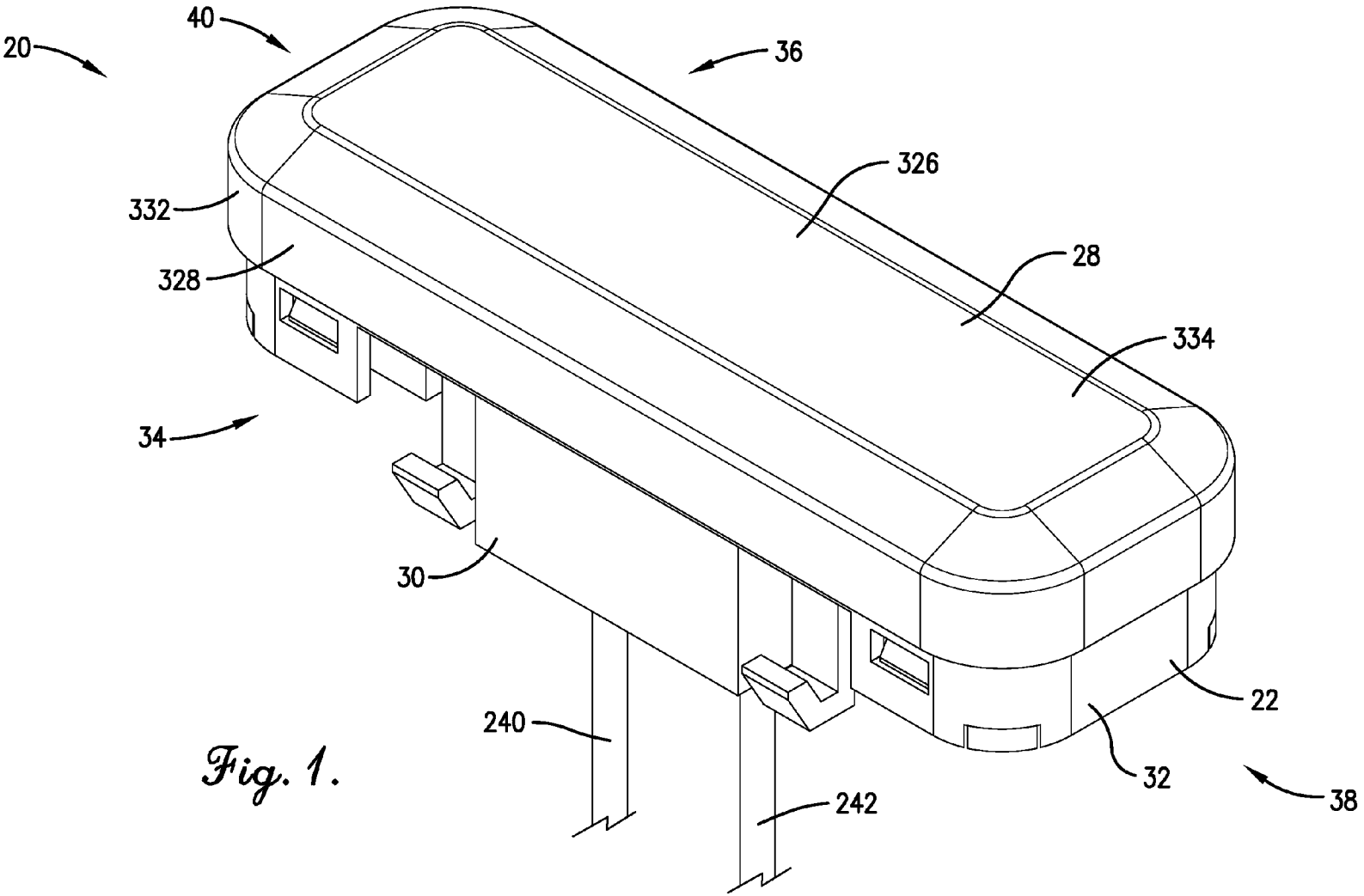
FIG. 1 is a top perspective view of a switch assembly constructed in accordance with the principles of a principal preferred embodiment of the present invention.
Figure 2:
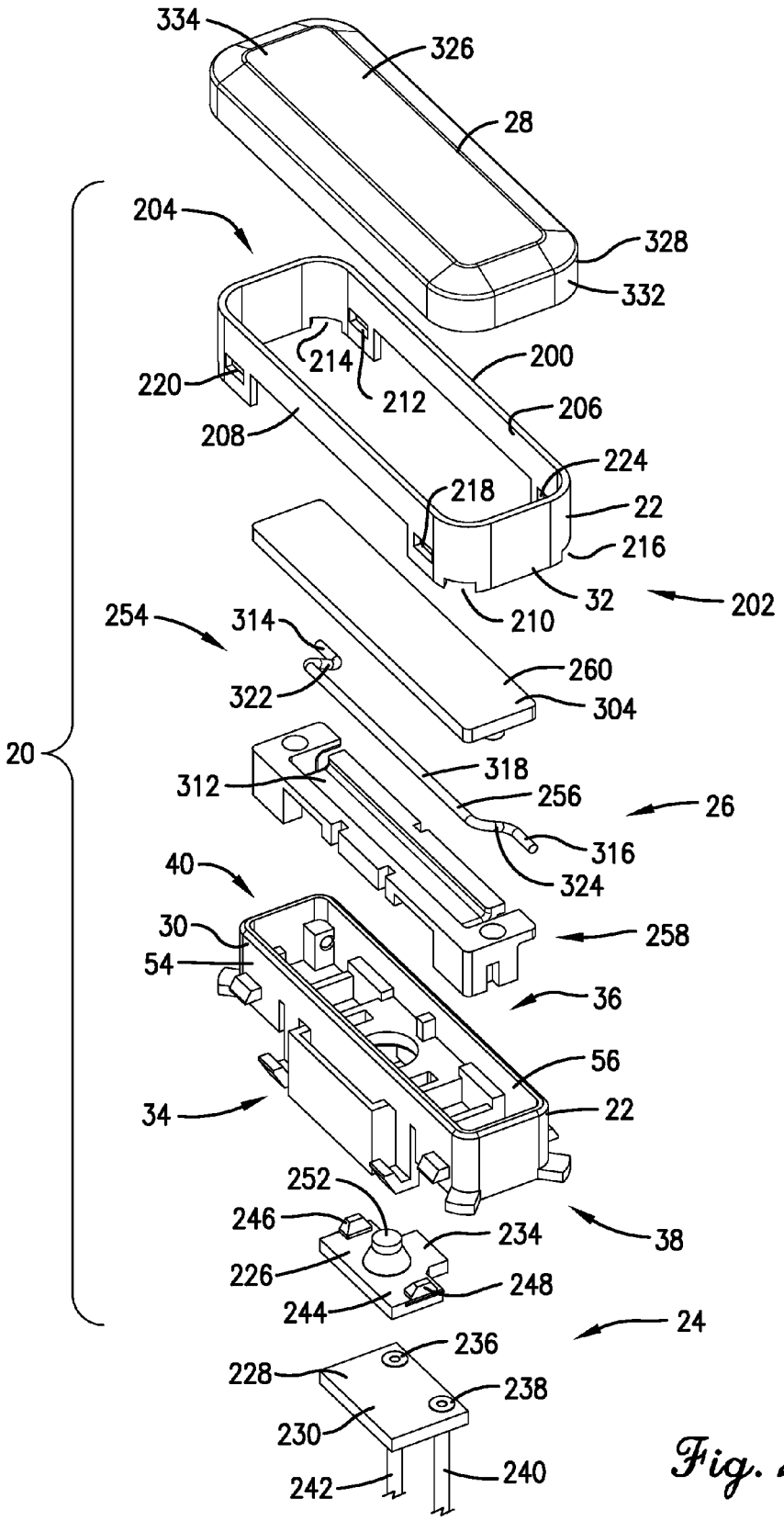
FIG. 2 is a top perspective exploded view of the switch assembly illustrated in FIG. 1.
Figure 3:
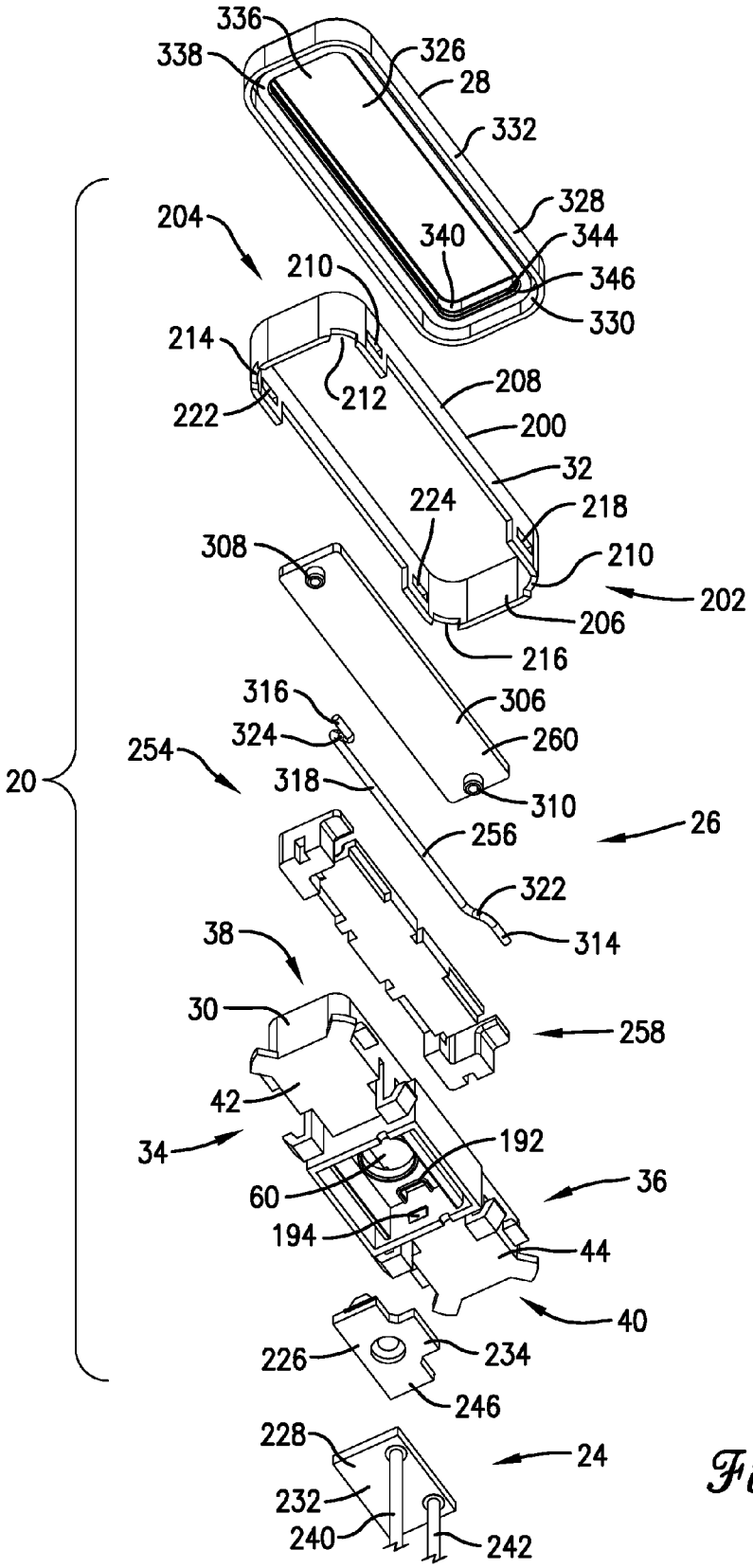
FIG. 3 is a bottom perspective exploded view of the switch assembly depicted in FIG. 1.
Figure 4:
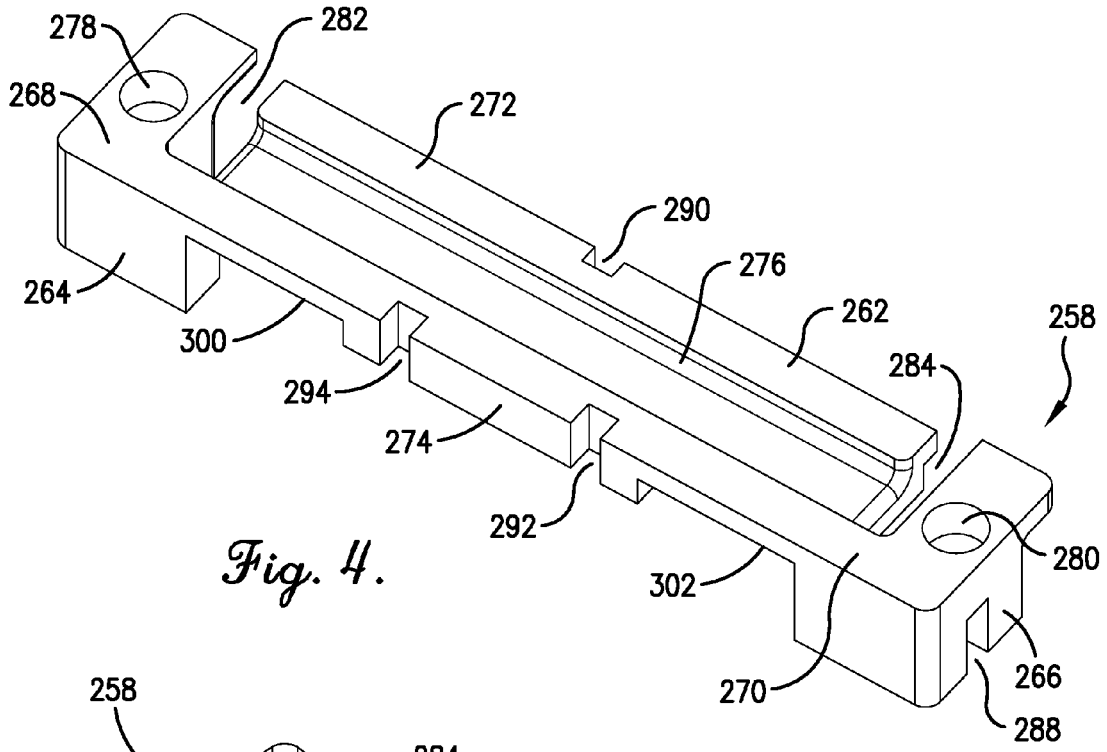
FIG. 4 is an enlarged top perspective view of an actuator body.
Figure 5:
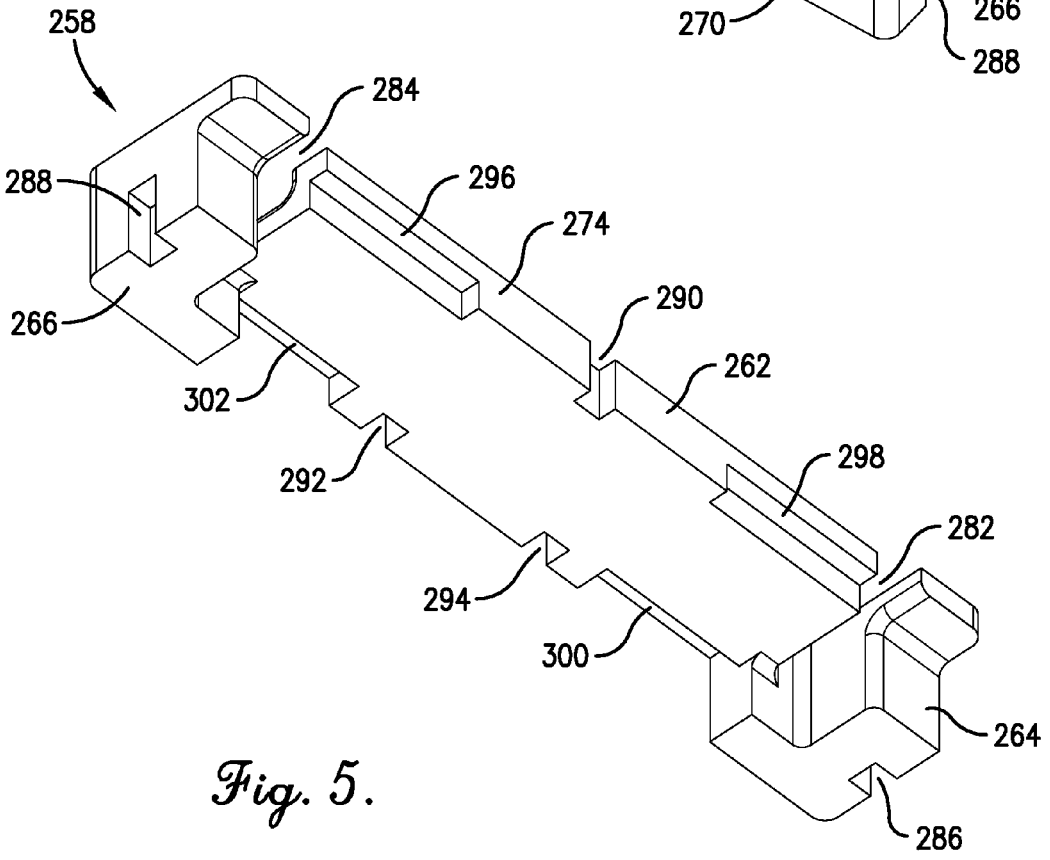
FIG. 5 is an enlarged bottom perspective view of the actuator body.
Figure 6:
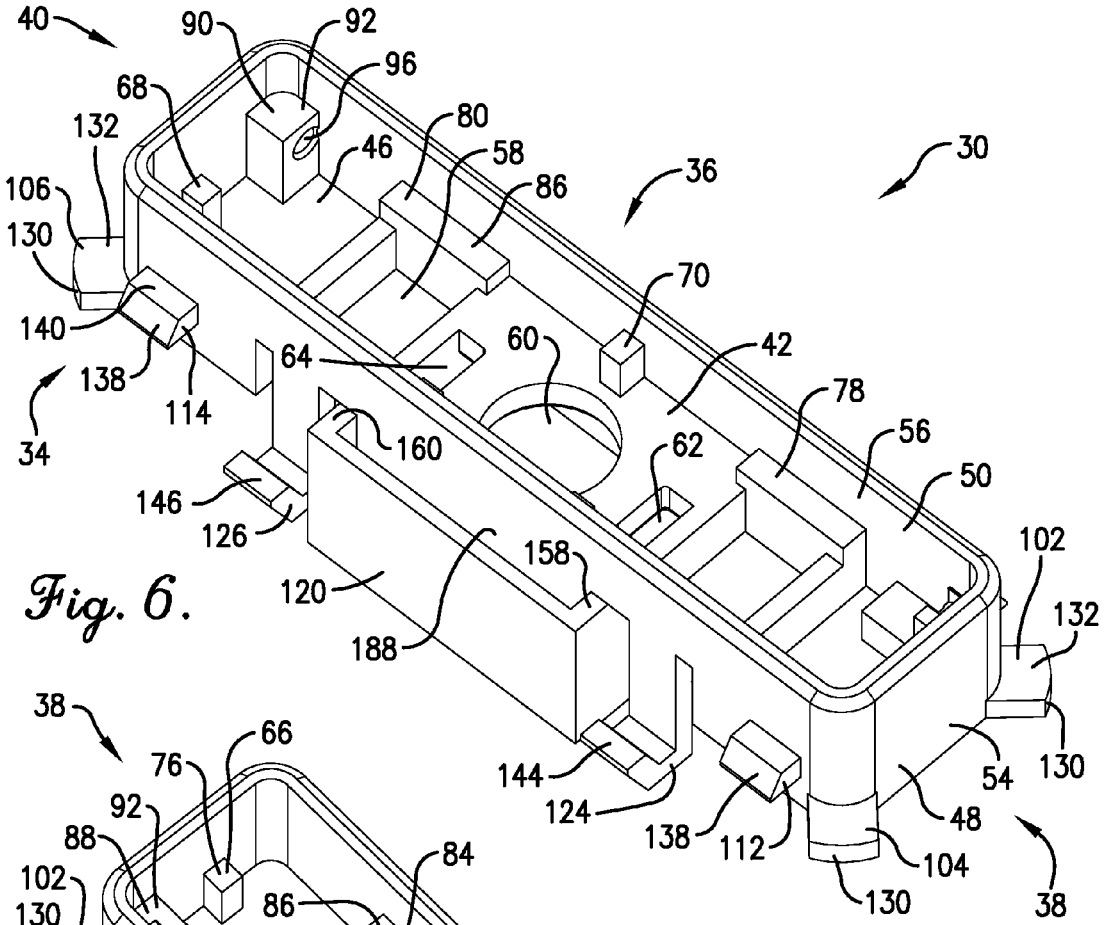
FIG. 6 is an enlarged top perspective view of a case of the switch assembly.
Figure 7:
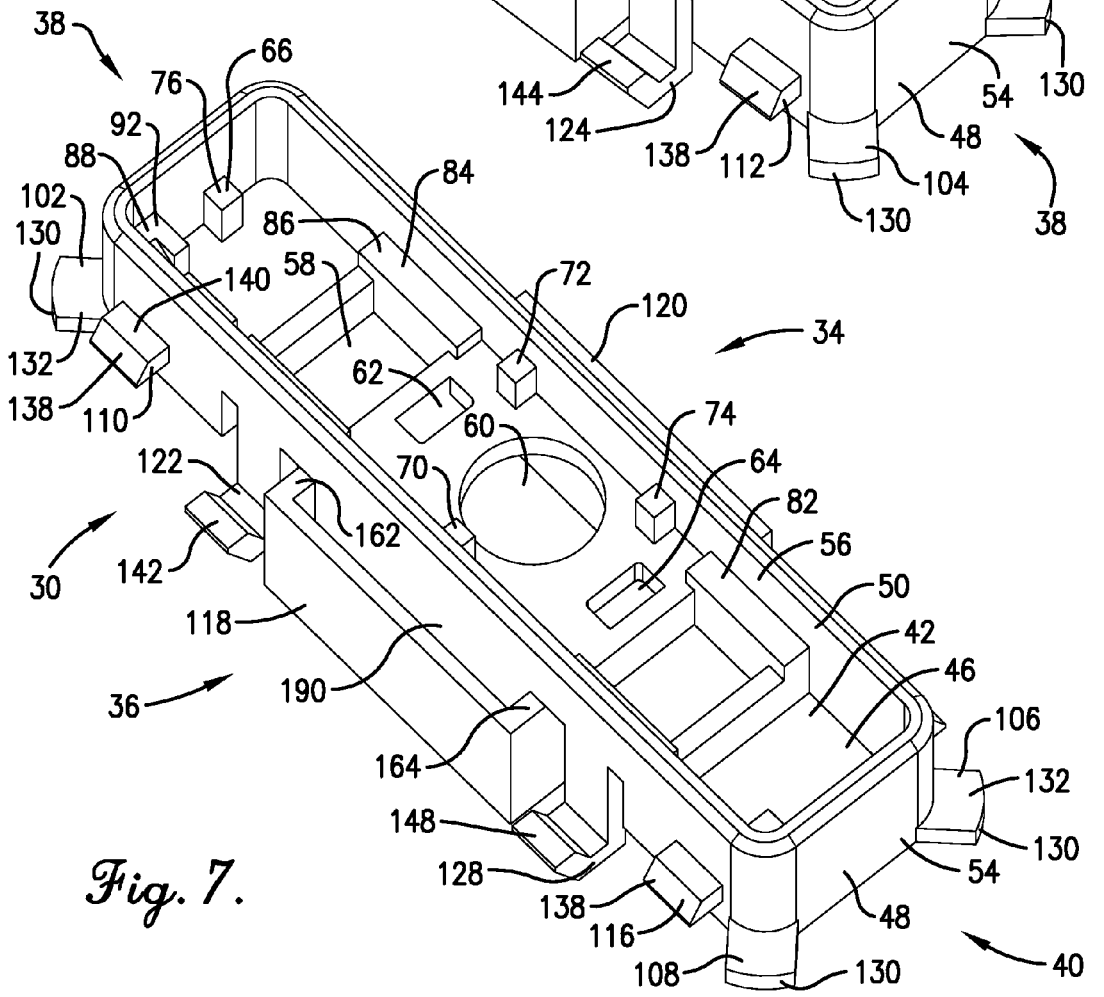
FIG. 7 is an enlarged top perspective view of the case showing the case rotated approximately 180° from the case shown in FIG. 6.
Figure 8:
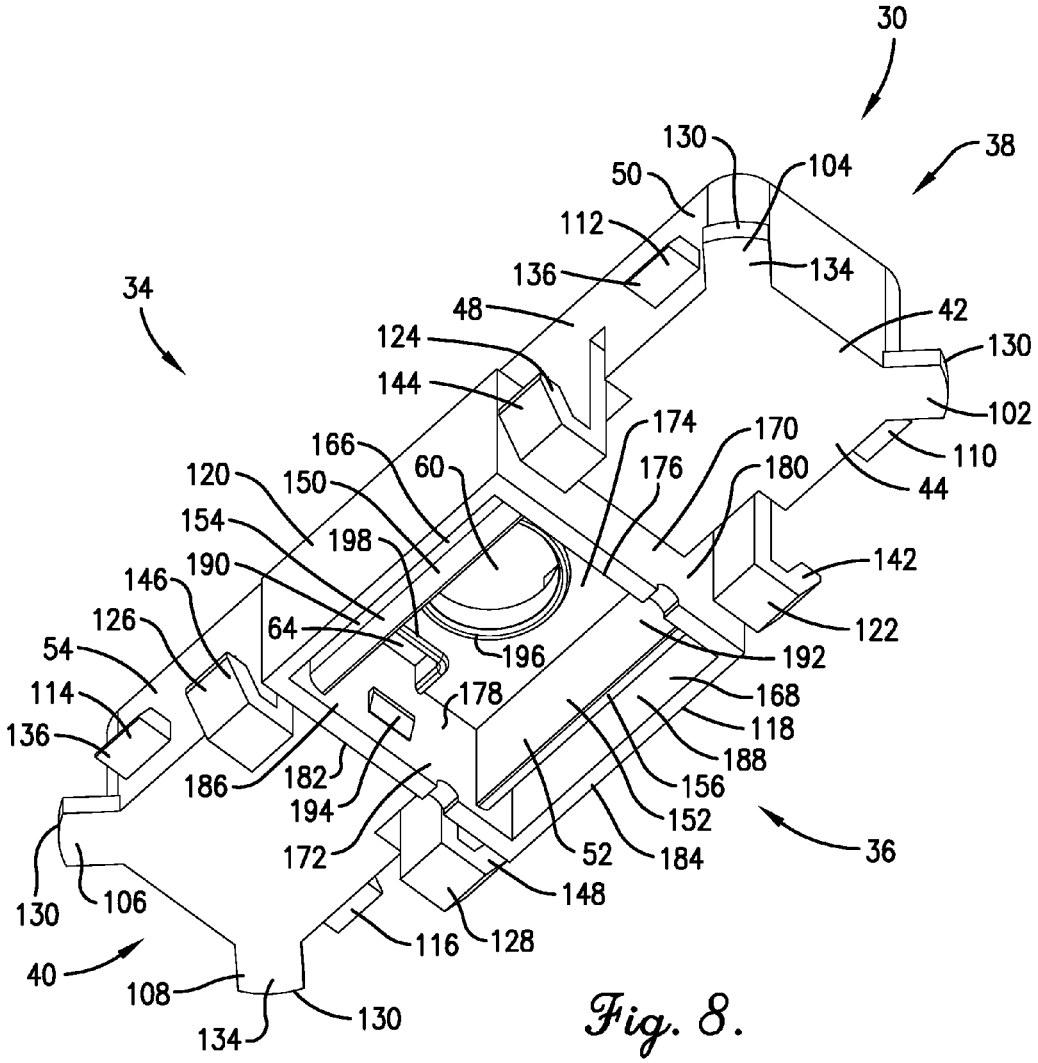
FIG. 8 is an enlarged bottom perspective view of the case.
Figure 9:
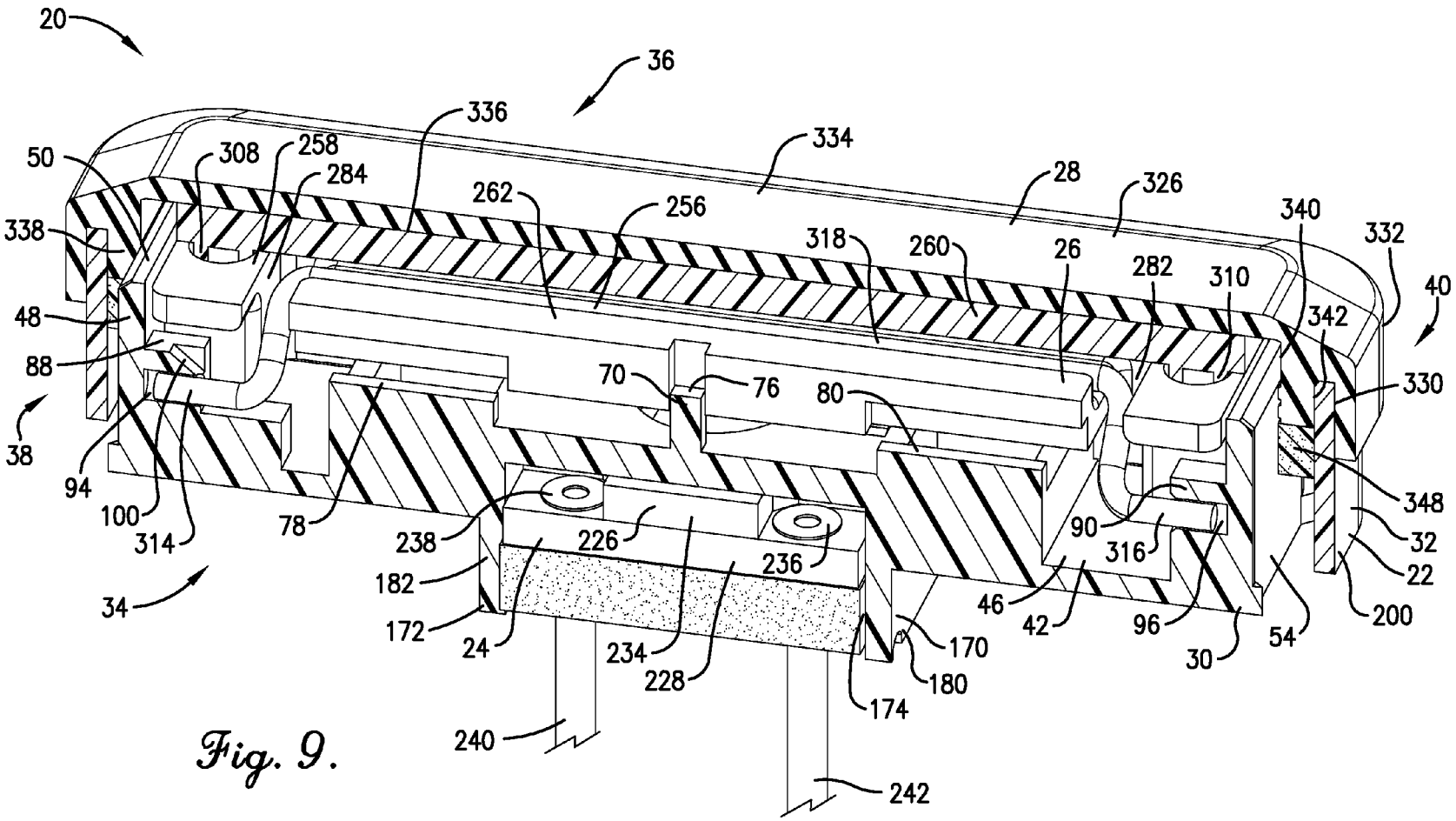
FIG. 9 is a cross-sectional view of the switch assembly, particularly showing the assembly of the pad, housing, actuator assembly, and switch mechanism.
Figure 10:
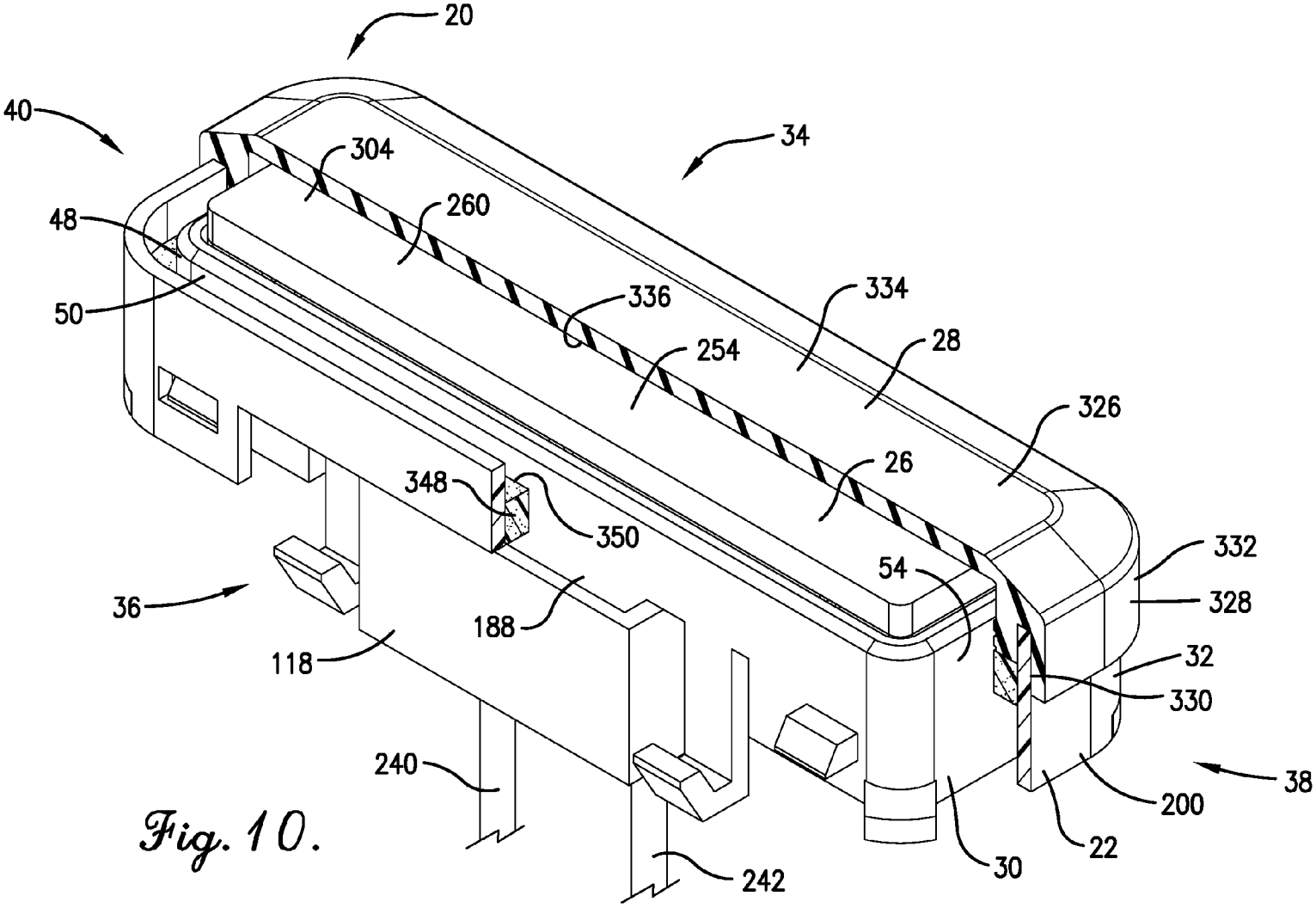
FIG. 10 is a top perspective view of the switch assembly with a portion of the pad and latching ring removed, particularly depicting a circumferential opening defined by the housing.
Figure 11:
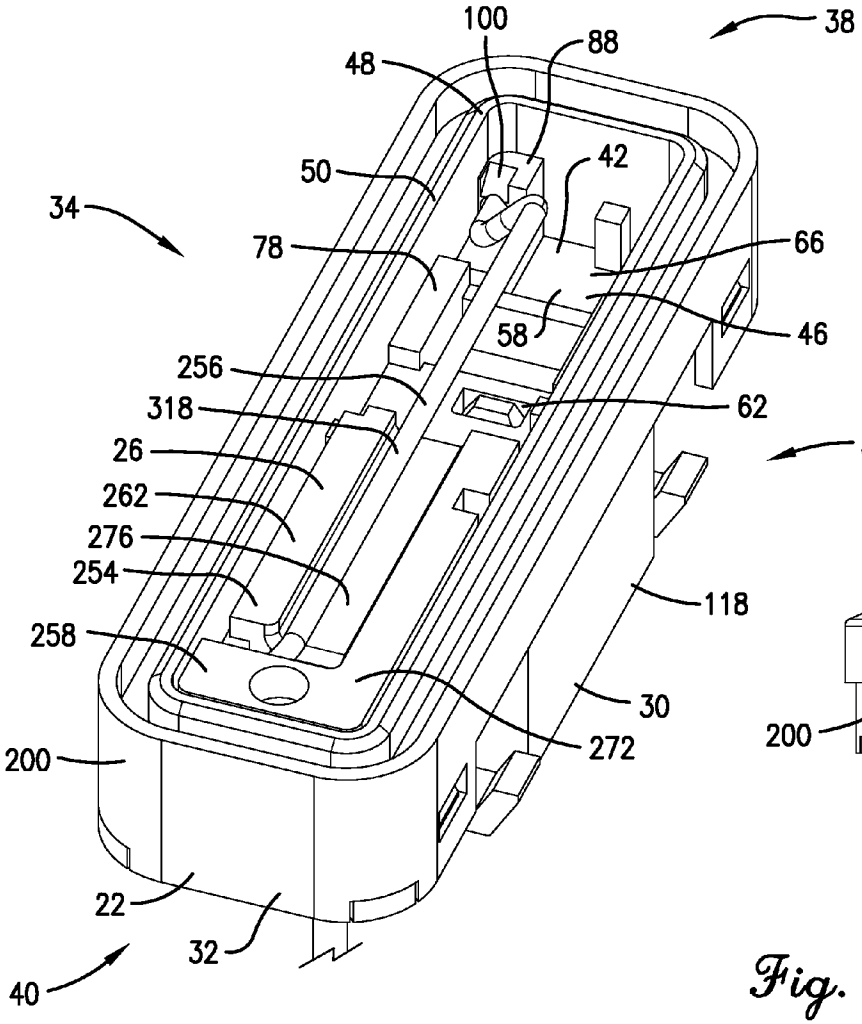
FIG. 11 is a top perspective view of the switch assembly with the pad, actuator cap, and a portion of the actuator body removed.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 12:
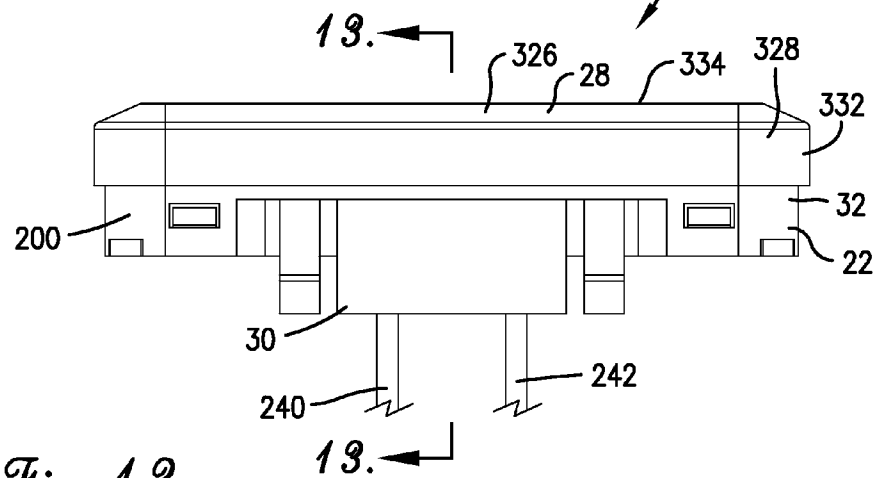
FIG. 12 is an elevation view of the switch assembly.

With reference to the drawings, wherein like reference numerals designate like parts and assemblies throughout the several views, FIGS. 1 and 12 shows the preferred embodiment of a manually operated switch assembly 20. The switch assembly 20 is configured to be used in a variety of industries and environments to toggle or actuate an object's state. For instance, the illustrated switch assembly 20 may operably be used in the automotive industries where the switch assembly 20 actuates mechanical, electronic, and/or electromechanical objects, such as a vehicle's door handle, trunk release mechanism, or the like. Accordingly, in such circumstances, the switch assembly 20 depicted herein is operably resilient and resistant to a variety of environmental conditions that may otherwise deteriorate and/or compromise the proper operation of the switch assembly 20. Thus, the switch assembly 20 preferably withstands repeated temperature fluctuations, substantial amounts of precipitation, high pressures, substantial heat, and the like, all of which are conditions commonly encountered by a vehicle in ordinary use. Although the illustrated switch assembly 20 is described herein in relation to the automotive industry, those of ordinary skill in the art will appreciate the numerous alternative applications and industries in which the illustrated switch assembly 20 may be used as a result of its advantageous characteristics further described herein.

The switch assembly 20 broadly includes a housing 22, a switch mechanism 24, an actuator assembly 26, and a flexible pad 28. With particular reference to FIGS. 2-3 and 6-8, the housing 22 comprises a case 30 and a latching ring 32, and is configured to be supportably mounted and/or secured to a vehicle (not depicted) or the like. Notably, the case 30 is preferably formed of a rigid plastic and is generally rectangular in shape, having two sides 34,36, and two ends 38,40 with a length therebetween. The case 30 includes a floor 42 presenting a substantially planar outer floor surface 44 and an inner floor surface 46, both of which having a common length. The case 30 further includes an upright wall 48 projecting perpendicularly in both directions from the floor 42. In one direction the top wall portion 50 extends continuously around the floor 42 to substantially circumscribe the periphery of the case 30. The bottom wall portion 52 extends in the opposite direction as the top wall portion 50. The peripheral top wall portion 50 operably presents an outer wall surface 54 and an inner wall surface 56. The top wall portion 50 is preferably rounded at each of the four corners of the generally rectangularly-shaped case 30.

The inner wall surface 56 and the inner floor surface 46 cooperatively define an actuation chamber 58 having a depth configured to shiftably receive the actuator assembly 26. In particular, located at the center of the length of the inner floor surface 46 is a generally circularly shaped switch mechanism aperture 60 that is dimensioned to receive a portion of the switch mechanism 24 as further described below. Likewise, the inner floor surface 46 presents a pair of switch mechanism alignment slots 62,64, with each alignment slot 62,64 being spaced from the switch mechanism aperture 60 on opposing sides thereof along the inner floor surface 46. Although the inner floor surface 46 is shown presenting various contours, those of ordinary skill in the art will appreciate that the contours may be varied, or indeed nonexistent, depending upon the design needs of the switch assembly 20.

The periphery of the inner wall surface 56 presents a plurality of inwardly projecting rails 66,68,70,72,74 that preferably extend transversely from the inner floor surface 46. The rails 66,68,70,72,74 preferably extend vertically along only part of the top wall portion 50, although those components could alternatively be coextensive if desired. In particular, two end rails 66,68 are located at respective ends 38,40 of the floor 42 and extend substantially vertically from the inner floor surface 46 along the inner wall surface 56. A set of three central rails 70,72,74 are located more proximate the switch mechanism aperture 60 and, like the end rails 66,68, extend substantially vertically from the inner floor surface 46 along the inner wall surface 56. Two of the central rails 72,74 are located on one side of the inner wall surface 56. The third central rail 70 is located on the opposite side of the inner wall surface 56. In this manner, the central rails 70,72,74 are oriented around the switch mechanism aperture 60 at intervals of approximately 120° from each other. Each of the rails 66,68,70,72,74 terminate in a generally flat top surface 76. Finally, the inner wall surface 56 presents four spaced abutments 78,80,82,84 extending from the inner floor surface 46. Each abutment 78,80,82,84 extends along part of the height of the upright wall 48, but to a height generally shorter than each of the respective 66,68,70,72,74 rails. The top surface 86 presented by each abutment 78,80,82,84 is generally flat.

The inner floor surface 46 presents a pair of respective anchor columns 88,90 at opposite common corners of the floor 42. Each of the anchor columns 88,90 extend substantially vertically from the inner floor surface 46 along the inner wall surface 56 and terminate at a generally flat top 92. Near the top of each anchor column 88,90 are respective inwardly facing bores 94,96. Each bore 94,96 is aligned with respect to the other to be located at a common height and present an axis 98 defining a pivot location. One of the illustrated anchor columns 88 includes a sloped ramp 100 leading to its respective bore 94. As will be seen, each of the rails 66,68,70,72,74, abutments 78,80,82,84, anchor columns 88,90, and bores 94,96 cooperatively interact with the actuator assembly 26 to ensure proper fitment, alignment, and shifting of the actuator assembly 26 when the switch assembly 20 is in use. Further, while the illustrated rails 66,68,70,72,74, abutments 78,80, 82,84, and anchor columns 88,90 are preferably integrally formed with the case 30 at particular locations therein, those of ordinary skill in the art will recognize that the rails 66,68, 70,72,74, abutments 78,80,82,84, and anchor columns 88,90 may be separately formed and joined to the case 30. Moreover, the relative spacing, and respective heights and locations of the rails 66,68,70,72,74, abutments 78,80,82,84, and anchor columns 88,90 may be variously configured without departing from the scope of the embodiments claimed herein.

Still referring generally to FIGS. 2-3, and 6-8, the outer wall surface 54 of the upright wall 48 generally presents a set of stop tabs 102,104,106,108, latching ring tabs 110,112,114, 116, channel walls 118,120, and securement tabs 122,124, 126,128. More particularly, the four illustrated stop tabs 102, 104,106,108 project generally perpendicularly outwardly from the upright wall 48, with respective stop tabs 102,104, 106,108 located at each of the rounded corners. Each tab stop 102,104,106,108 extends outwardly from the outer wall surface 54 and terminate at a generally arcuate edge 130. The tab stops 102,104,106,108 are substantially coplanar with the floor 42 of the case 30. Each tab stop 102,104,106,108 presents a generally flat upper tab stop surface 132 and a generally flat lower tab stop surface 134. The four latching ring tabs 110,112,114,116 are spaced along the periphery of the outer wall surface 54. Notably, each side 34,36 of the case 30 has a pair of spaced latching ring tabs projecting from the outer wall surface 54 adjacent respective stop tabs 102,104,106, 108. More particularly, each of the respective latching ring tabs 110,112,114,116 presents a bottom surface 136 having a tapered section 138, with the tapered section 138 angling outwardly to a top surface 140 of the respective ring tabs 110,112,114,116. As will be described in further detail herein, the stop tabs 102,104,106,108 and latching ring tabs 110,112,114,116 cooperatively interact with the latching ring 32 to ensure proper interconnection of the latching ring 32 and case 30.

Four securement tabs 122,124,126,128 are similarly spaced along the periphery of the outer wall surface 54. More particularly, each side of the case 30 has a pair of securement tabs projecting downwardly from the outer wall surface 54 and terminating in outwardly facing hooks 142,144,146,148. Each securement tab 122,124,126,128 is preferably resiliently flexible in such a manner so that when the case 30 is mountably coupled to a vehicle or the like, each of the securement tabs 122,124,126,128 resiliently flexes until the hooks 142,144,146,148 are engageable with the vehicle to secure the case 30 to the vehicle for use. Those of ordinary skill in the art will recognize that the switch assembly 20 may be alternatively configured for attachment to the corresponding structure. For example, any of a plurality of mechanisms, structures, and bonding agents may be used to couple the case 30 to an object, such as a vehicle, for use therewith.

The bottom portion of the wall 52 generally includes two spaced apart wall sections 150,152. Each of the wall sections 150,152 is generally shorter than the length of the case 30 and only extends partly along the length of the case 30. The illustrated wall sections 150,152 are generally centrally located with respect to the floor 42 of the case 30. Moreover, each wall section 150,152 presents an outwardly facing rounded top edge 154,156. Thus, the outer wall surface 154 is cooperatively defined by both the top wall portion 50 and the bottom wall portion 52 of the wall 48.

Each side 34,36 of the case 30 presents a pair of spacers 158,160,162,164 projecting substantially perpendicularly from the outer wall surface 54 and being joined by respective channel walls 118,120 having an outer surface 166 and an inner surface 168. The spacers 158,160,162,164 and channel walls 118,120 extend downwardly beyond the outer floor surface 44. Spaced on opposite sides of the switch mechanism aperture 60 are a pair of cross-walls 170,172 projecting from the outer floor surface 44 and intersecting the sections of the bottom wall portion 52 to cooperatively define a switch mechanism compartment 174. The cross-walls 170,172 are preferably aligned with the spacers 158,160,162,164 and serve to integrate the channel walls 118,120. The cross-walls 170,172 each have inner 176,178 and outer 180,182 surfaces extending downwardly from the outer floor surface 44 and across the width of the case 30. In this manner, the channel walls 118,120 and respective cross-walls 170,172 form an integral channel frame 184 having a depth below the floor. The frame 184 is generally square in shape and presents an internal frame area 186. Within the frame area 186, on each side of the case 30, each wall section of 150,152 the bottom wall portion 52 extends downwardly beyond the outer floor surface 44 in a substantially parallel orientation with respective channel walls 118,120, and terminates at a depth shallower than the depth of the frame 184. Thus, the inner surface 168 of the channel wall is spaced from the outer wall surface 54 of the respective section of the wall portion to thereby define channels 188,190 on opposite sides of the case 30, with the channels 188,190 extending from the bottom of the tapered upright wall to the top of the channel walls 118,120.

The peripheral bottom wall portion 52 extending below the floor 42 of the case 30, the inner wall surfaces 176,178 of the cross-walls 170,172, and the outer floor surface 44 cooperatively define a switch opening 192 at the bottom of the switch compartment 174. The opposing inner wall surfaces 176,178 of the cross-walls 170,172 present identical inwardly facing tapered lock tabs 194, which are configured to retain the switch mechanism 24 within the switch compartment 174. In addition, the outer floor surface 44 includes a downwardly projecting switch aperture collar 196 that circumscribes the periphery of the switch aperture 60. Likewise, the outer floor surface 44 presents ridges 198 circumscribing the periphery of each of the alignment slots 62,64 located on opposing sides of the switch aperture 60.

The latching ring 32 generally includes a generally rectangularly shaped frame wall 200 having two ends 202,204 with a length therebetween. The frame wall 200 presents an inner 206 and outer 208 surface. The substantial length of the frame wall 200 is shorter than respective ends thereof. The lower edge of the frame wall includes slots 210,212,214,216 at each of the four corners, with each slot 210,212,214,216 being sized to receive respective ones of the stop tabs 102,104,106, 108 projecting from the outer surface 54 of the wall 48 of the case 30. Likewise, adjacent the slots 210,212,214,216 are respective latch apertures 218,220,222,224, each of which is dimensioned to receive respective securement tabs 122,124, 126,128 projecting from the outer surface 54 of the wall 48 of the case 30. The circumference of the frame wall 200 is so dimensioned to extend around the periphery of, and be spaced from, the outer wall surface 54 of the case 30. The frame wall 200 is joined to the outer wall surface 54 of the case 30, such that the case 30 and latching ring 32 cooperatively form the housing 22 of the switch assembly 20. In this manner, the cooperation of the latching ring tabs 110,112,114,116 with the latching apertures 218,220,222,224 and the slots 210,212, 214,216 with the stop tabs 102,104,106,108 ensure proper alignment and fitment of the latching ring 32 about the case 30 to form the housing 22. Moreover, the assembled housing 22 defines a generally circumferential opening circumscribing the case 30, with the circumferential opening being defined between the outer surface 54 of the wall 48 of the case 30 and the inner surface 206 of the latching ring 32 (see, e.g., FIGS. 10, 15-17).

Now referring generally to FIGS. 2-3, and 13-14, the illustrated switch mechanism 24 generally includes a switch 226 supported by a contact board 228. The contact board 228 presents top 230 and bottom 232 surfaces and is of the known variety and preferably formed of a substantially insulating substrate. The contact board 228 is generally rectangular in shape and includes two ends defining a length therebetween, but also includes a tab 234 projecting from one side thereof. The top surface 230 of the contact board 228 operably mechanically supports the switch 226, which abuts and communicates with the top surface 230 thereof. The contact board 228 also preferably includes electronic pathways and/or other electrical components thereon and/or embedded therein (not shown herein). Those of ordinary skill in the art will readily recognize that the electrical pathways are preferably etched within the substrate, but any electrically conducting pathways will operably suffice to enable the contact board 228 to perform its designed function. The bottom surface 232 of the contact board 228 includes a pair of collars 236, 238 located at opposite common corners thereof, each of which operably support first and second respective lead wires 240,242 protruding preferably orthogonally from the bottom surface 232 of the contact board 228. In this manner the lead wires 240, 242 electrically connect the contact board 228 to, and cause the board to form part of, a circuit associated with an object to be controlled and/or actuated by the switch assembly 20. While the contact board 228 shown herein is relatively simple in construction and function, those of ordinary skill in the art will immediately appreciate the variety of configurations and/or functions capably performed by the logic and/or circuitry imprinted and/or embedded in the contact board 228. Indeed, the board 228 may have a vast number of electrical pathways and electrical components integrated therewith. Moreover, the contact board 228 may include any number of pathways, components and/or lead wires to accomplish any potential design requirements.

The illustrated switch 226 includes top 244 and bottom 246 surfaces. The bottom surface 246 of the switch is mechanically supported by the top surface 230 of the contact board 228. The top surface 244 of the switch 226 preferably includes a pair of generally trapezoidally-shaped projections 248,250, with each projection 248,250 extending substantially perpendicularly from the top surface 244 thereof. The illustrated switch 226 preferably includes a rubber dome 252 located midway between each of the respective projections 248,250 and extends substantially perpendicularly from the top surface 244 of the switch 226. In particular, the illustrated dome 252 is preferably formed of rubber, silicone, or the like, and capable of withstanding a suitable number of depression cycles given the design goals of the switch assembly 20. Indeed, the dome 252 is preferably resilient such that forces applied to the dome 252 cause the dome 252 to compressibly and resiliently flex, operatively opening or closing the circuit defined in part by the switch 226 and/or the contact board 228 supporting the switch 226. Moreover, when compressive forces are no longer applied to the dome 252, the dome 252 resiliently springs back to its initial non-depressed state. One of ordinary skill in the art will appreciate that any suitable one of a variety of switches, such as tact, push-button, toggle, momentary, and the like, may operatively be used with the switch assembly 20 described herein. Moreover, while the switch mechanism 24 illustrated herein only contains a single switch 226, a plurality of switches may operatively be utilized thereon without departing from the ambit of the present invention.

The illustrated switch mechanism 24 is preferably configured to be matingly received within the switch opening 192. In particular, the switch 226 is inserted so that the dome 252 of the switch 226 is received and protrudes through the switch aperture 60. When properly oriented, the projections 248,250 protrude through the switch mechanism alignment slots 62,64. In this manner, the switch mechanism 24 is properly oriented within the switch compartment 174. Further, the switch mechanism 24 is operatively snapped into place within the switch compartment 174 by virtue of the identical tapered lock tabs 194, Thus, once assembled, the dome 252 is accessible through the switch aperture 60 and the lead wires 240, 242 protrude from the switch compartment 174, and the switch mechanism 24 is preferably permanently retained in the switch opening 192 by the lock tabs 194.

Referring now generally to FIGS. 2-5, the illustrated actuator assembly 26 broadly includes an actuator 254 and a stability element 256. In particular, the actuator 254 shown herein generally includes an actuator body 258 and an actuator cap 260. The illustrated actuator body 258 preferably includes a rectangularly-shaped platform 262 having two ends and a length therebetween. The platform 262 adjoins risers 264,266 at opposing ends thereof by respective bridges 268,270. The risers 264,266, bridges 268,270, and platform 262 each present a unitary top surface 272 and peripheral edge 274 extending about the periphery of the actuator body 258. Notably, the top surface 272 of the platform 262 spans the substantial length of the actuator body 258 and includes a depression 276 running the length thereof. Also, the top surface 272 of the each of the risers 264,266 includes a generally cylindrically-shaped pit 278,280. Each end of the platform 262 cooperates with the respective bridges 268,270 and risers 264,266 to define respective throats 282,284 generally spacing the risers 264,266 from respective ends of the platform 262. Further, the platform 262 and risers 264,266 present bottom surfaces such that the height of the platform 262 from the bottom surface to the top surface 272 is preferably at least approximately half the dimension of the height of the respective risers 264,266 from the bottom surfaces thereof to the top surface 272.

The peripheral edge 274 of the actuator body 258 includes a plurality of vertical slots 286,288,290,292,294 therein. For instance, a set of three spaced vertical slots 290,292,294 are located along the periphery of the platform 262 and extend from the top surface 272 to the bottom surface of the actuator body 258. In the illustrated embodiment two of the slots 292,294 are located opposite a single remaining 290 slot on the opposite side thereof. Moreover, respective end slots 286, 288 are located on each of the respective risers 264,266 and extend from the bottom surface of the risers 264,266, but preferably do not extend to the top surface 272 of the risers 264,266. Further, the bottom surface of the platform 262 presents four ledges 296,298,300,302 defined by the peripheral edge 274 of the actuator body 258 and the bottom surface of the platform 262. As will be described further herein, each of these vertical slots 286,288,290,292,294 and ledges 296, 298,300,302 cooperate with respective rails 66,68,70,72,74 and abutments 78,80,82,84 of the case 30 to ensure proper alignment, fitment, and proper sliding action of the actuator 254 relative to the housing 22.

The illustrated actuator cap 260 is generally rectangularly-shaped and has a length between respective ends thereof. The cap 260 presents generally flat top 304 and bottom 306 surfaces. The bottom surface 306 of the actuator cap 260 preferably presents downwardly projecting, hollow, cylindrically shaped projections 308,310 at opposing ends of the cap 260. Each of the projections 308,310 preferably extends substantially perpendicular from the bottom surface 306 of the actuator cap 260 and is so dimensioned to be received in respective pits 278,280 on the top surface 272 of the actuator body 258. In this manner, an actuator channel 312 is thereby defined by the bottom surface 306 of the actuator cap 260 and the depression 276 formed along the length of the platform 262 of the actuator body 258. Moreover, while the actuator cap 260 selected for illustration herein substantially covers the entire top surface 272 of the actuator body 258, those of ordinary skill in the art will readily recognize that the actuator cap 260 may be variously configured and may only cover a portion of the platform 262. Additionally, the actuator cap 260 may be coupled and/or secured to the actuator body 258 with a variety of known mechanical structures and/or adhesive compounds or elements.

The stability element 256 selected for illustration herein is generally cylindrical in cross-section and u-shaped. Specifically, the preferred element 256 has a pair of end prongs 314,316 and a substantially straight bight 318 extending therebetween. In particular, the end prongs 314,316 of the stability element 256 are substantially coaxially oriented to define a pivot 320 of the element 256, as will be described. The bight 318 is spaced from the axis by respective vertical legs 322, 324 joining the end prongs 314,316 to the substantially straight bight 318. While the depicted stability element 256 is formed of metal, the stability element 256 may be formed of any suitably rigid material.

Referring now to FIGS. 2-3, 11, and 13-14, the bight 318 of the stability element 256 is received within the actuator channel 312 when the actuator assembly 26 is assembled. Moreover, the vertical legs 322,324 of the stability element 256 are received within the respective throats 282,284 of the actuator body 258. In this manner, the bight 318 of the stability element 256 is shiftably received within the actuator channel 312. Thusly assembled, the actuator assembly 26 is receivable within the actuation chamber 58 defined by the case 30. With particular reference to FIGS. 2-3, 9-11, and 13-14, the respective end prongs 314,316 of the stability element 256 are received within the bores 94,96 of the anchor columns 88,90. In particular, after the first end prong 314 is inserted into the first bore 94, the sloped ramp 100 facilitates receipt of the other end prong 316 in the other bore 96. That is, the stability element 256 will resiliently snap into the bore 96 once the biasing action presented by the sloped ramp 100 is overcome. In addition, the actuator body 258 and case 30 are cooperatively positioned so that the respective slots 286,288,290,292, 294 align with respective rails 66,68,70,72,74, thereby providing proper fitment and alignment of the actuator body 258 in the case 30. Furthermore, the respective ledges 296,298, 300,302 presented by the bottom surface of the platform 262 are configured to be aligned with respective abutments 78,80, 82,84 presented by the inner wall surface 56 of the top wall portion 50. The actuator body 258, and particularly the bottom surface of the platform 262 thereof, is configured to overlie, and preferably abut, the dome 252 protruding through the switch aperture 60. Thusly assembled, the case 30, actuator assembly 26, and switch mechanism 24 are configured to open or close a circuit upon actuation of the actuator assembly 26.

Those of ordinary skill in the art will readily recognize that various other structures may be present to facilitate assembly of the actuator assembly 26 with the case 30. In particular, either or both of the anchor columns 88,90 may include a sloped ramp to facilitate insertion of the end prongs 314,316 within respective bores 94,96. Moreover, variously configured vertical slot and rail configurations, and varying tolerances to adjust how snugly the actuator assembly 26 is received within the case 30 may be implemented to achieve desired results. Indeed, although the illustrated case 30 and actuator body 258 present a number of cooperating slots and rails, those of ordinary skill in the art will appreciate that embodiments of the switch assembly 20 may not include any such structure. Furthermore, the switch mechanism 24 may be alternatively designed to present a plurality of domes, each of which may be actuatable by the actuator assembly 26.

Referring now generally to FIGS. 1-3, 9-10, and 12-14, the flexible pad 28 selected for illustration is generally rectangularly-shaped to correspond with the shape and design of the housing 22. The 28 pad broadly includes an engagement wall 326 and a generally upright circumferential sidewall 328 projecting from the outer periphery of the engagement wall 326. The sidewall 328 has inner 330 and outer 332 surfaces. The top of the sidewall 328 converges upwardly to the engagement wall 326. The engagement wall 326 presents top 334 and bottom 336 surfaces. The engagement wall 326 is preferably resiliently flexible to accept actuation forces applied by a user to the top surface 334 thereof. In particular, the pad 28 is preferably formed of an elastomeric material or any other of many resilient and, preferably, weatherproof materials. The pad 28 is designed to span the open end of the case 20, through which the actuator assembly 26 is accessed during switch assembly 20 operation. The housing 22 and pad 28 are preferably configured to accommodate depression by three fingers (not shown), but may alternatively be sized to various design parameters. The pad 28 generally accounts for acceptable ergonomic design principles. It has been determined that one suitable pad length is about 50 mm, although other suitable pad dimensions and designs are within the ambit of the present invention. The bottom surface 336 of the illustrated engagement wall 326 is generally planar, but preferably presents a circumferential inner bead wall 338 that projects generally downwardly from the bottom surface 336 and is spaced apart from, and generally parallel to, the sidewall 328. The bead wall 338 presents inner 340 and outer 342 surfaces. The spacing between the bead wall 338 and the sidewall 328 is configured to permit a friction fit of the latching ring 32 between the outer surface 342 of the bead wall 338 and the inner surface 330 of the sidewall 328. In addition, the inner surface 340 of the bead wall 338 presents a pair of preferably parallel spaced circumferential ribs 344,346. The ribs 344,346 preferably extend continuously about the inner surface 340 of the bead wall 338. The ribs 344,346 are configured to provide a friction fit with the outer wall surface 54 of the case 30. In this manner, the pad 28 is assembled with the case 30 and latching ring 32 such that the bottom surface 336 of the engagement wall 326 overlies the open end of the housing 22 and preferably provides a resilient, and preferably weatherproof, seal. Once assembled, the bottom surface 336 of the engagement wall 326 is configured to abut the actuator cap 260 to operably actuate the actuator assembly 26 when a force is exerted against the top surface 334 of the engagement wall 326.

Figure 14:
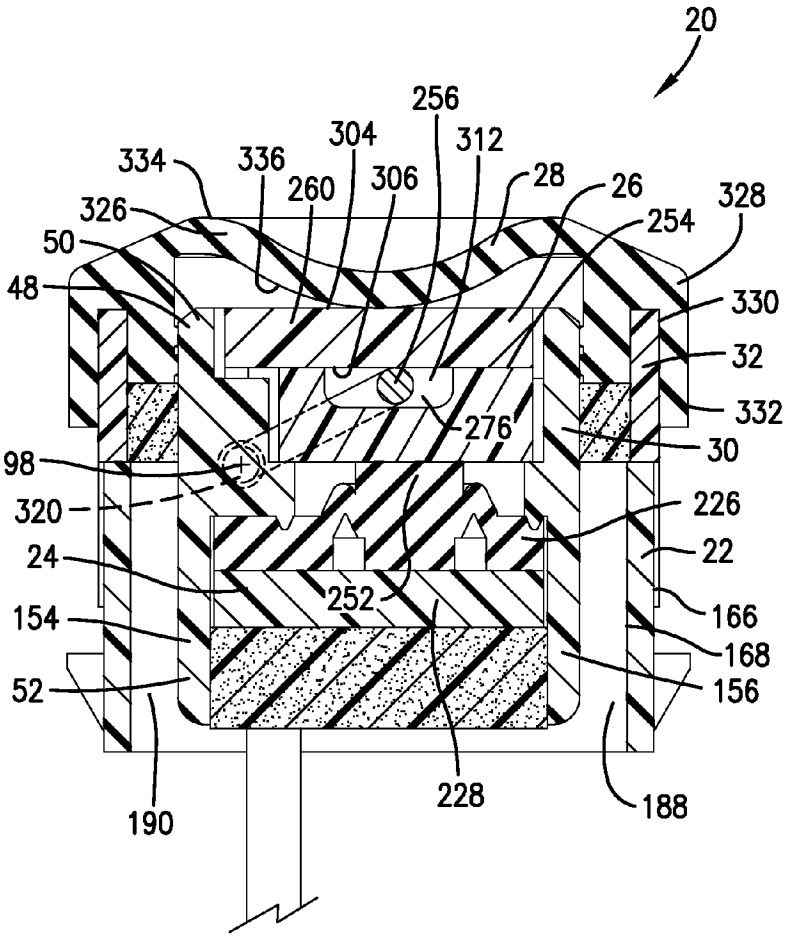
FIG. 14 is a sectional view of the switch assembly similar to FIG. 13, but depicting the switch assembly in a depressed state with the stability element shifted within the actuator.
Figure 13:
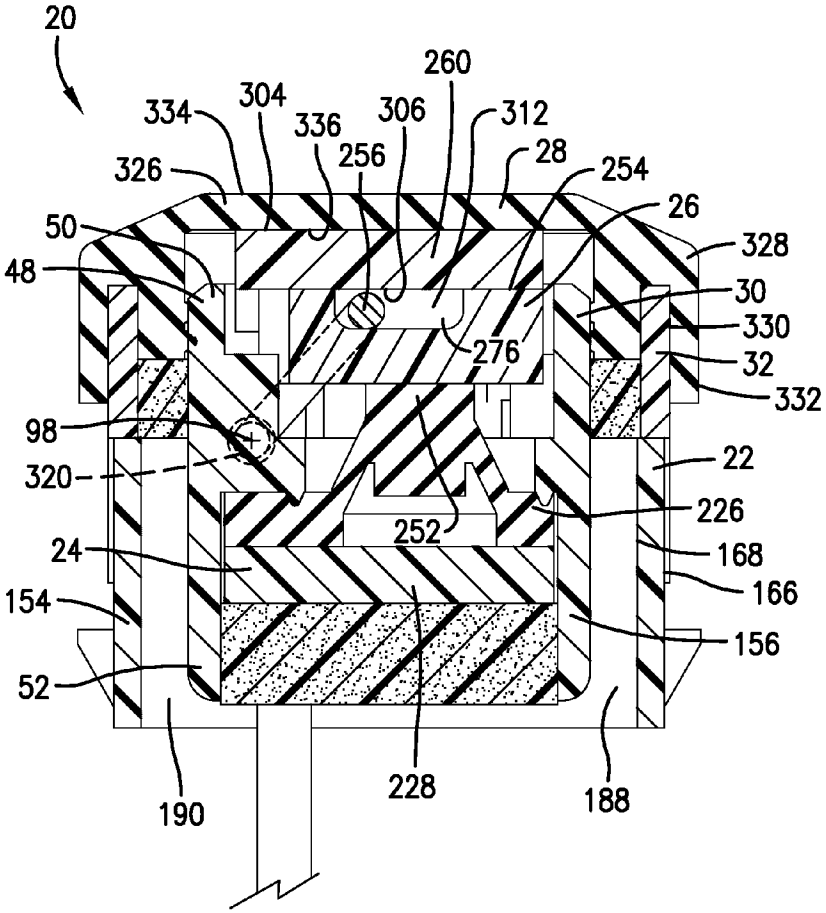
FIG. 13 is a sectional view of the switch assembly taken along the line 13-13 of FIG. 12, particularly depicting the switch assembly in a non-depressed state.

Operational views of the switch assembly 20 are particularly illustrated in FIGS. 13 and 14. When the illustrated switch assembly 20 is in its non-actuated state, such as shown in FIG. 13, the engagement wall 326 overlies and preferably abuts the actuator cap 260. The bight 318 of the stability element 256 is located within the actuator channel 312, and the end prongs 314,316 are rotatably received within respective bores 94,96 of the anchor columns 88,90. Thus, the stability element 256 is obliquely oriented within the case 30 and configured to pivot. Further, the actuator 254 overlies the dome 252 of the switch 226, which protrudes through the switch aperture 60 and is ready to be actuated. When a user contacts and presses against the engagement wall 326, such as illustrated in FIG. 14, the flexibility of the engagement wall 326 permits the engagement wall 326 to resiliently flex downwardly. Thus, upon depression, the bottom surface 336 of the engagement 326 wall travels downwardly according to the force applied by the user and, as a result of contact with the actuator cap 260, causes the actuator assembly 26 to likewise shift downwardly within the case 3. The downward shift of the actuator assembly 26 thereby actuates the dome 252 protruding through the switch aperture 60. That is, the dome 252 is flexed downwardly by the downwardly moving actuator 254 as shown in FIG. 14.

More particularly, with the end prongs 314,316 of the stability element 256 rotatably anchored to the case, the stability element 256 is limited to swinging about the pivot axis defined by the end prongs 314,316. As the stability element 256 pivots, the bight 318 slides within the actuator channel 312 (compare FIGS. 13 and 14). Because the bight 318 is captured between the actuator body 258 and the actuator cap 260, actuator movement is limited by the controlled swinging action of the stability element 256. In the illustrated embodiment, the actuator 254 is limited to generally linear movement (up and down movement) as a result of the interaction with the case 30. The linear movement of the actuator 254 causes swinging movement of the stability element 256, and the stability element 256 in turn ensures that the actuator 254 (which is substantially rigid) moves uniformly during operation of the switch assembly 20. Moreover, with the stability element 256 extending substantially the full length of the actuator 254, the actuator 254 is further limited to moving evenly between the ends thereof. That is, in the illustrated embodiment, the actuator 254 is prevented from becoming canted within the case 30 when depressed, ensuring the dome 252 is flexed (and the switch mechanism 24 is thereby actuated) regardless of where the user presses on the pad 28. Such an arrangement gives the user reliable tactile feedback, as a result of the even end-to-end movement of the actuator 254, that the switch mechanism 24 has assuredly been actuated. Although the case 30 and actuator 254 are also preferably designed to facilitate linear movement of the actuator 254 (e.g. through the interaction of the aforementioned rails and slots), such an arrangement may be removed without departing from the spirit of the present invention. Further, with the stability element 256 controlling movement of the actuator 254, such interengagement between the actuator 254 and case 30 need not be snug or have tight tolerances. Such a "loose" configuration ensures that the resiliency of the dome 252 is capable of returning the actuator 254 to the non-depressed position. In light of the foregoing, the switch mechanism 24 is operably depressed and optimally provides a uniform tactile feel to the user. When the user ceases depressing the engagement wall 326, the dome 252 resiliently urges the actuator 254 upwardly, thereby causing the stability element 256 to rotate about the axis and the bight 318 thereof to shift within the actuator channel 312. Likewise, the engagement wall 326 returns to its non-depressed state.

Figure 15:
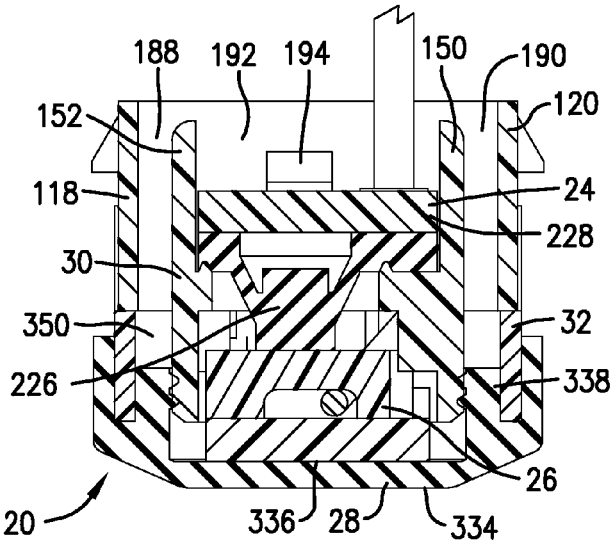
FIG. 15 is a sectional view of the switch assembly taken along the line 13-13 of FIG. 12, particularly depicting the switch and circumferential openings prior to the application of sealant.
Figure 16:
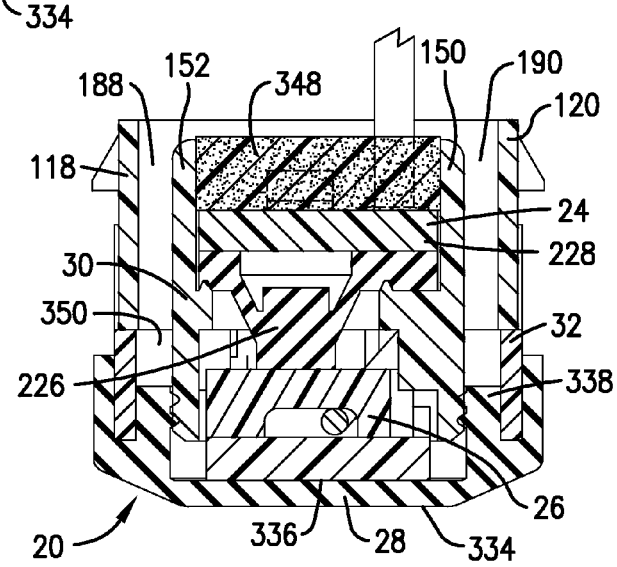
FIG. 16 is a sectional view of the switch assembly similar to FIG. 15, but depicting the switch opening having sealant deposited therein.

Additionally, operational views demonstrating how a curable liquid sealant 348 may operably be applied to the switch assembly 20 from a single sealant source (not shown) is illustrated in FIGS. 15-16. In particular, FIG. 15 illustrates the switch assembly 20 prior to the application of any curable liquid sealant 348, such as epoxy or the like, thereto. Notably, the switch assembly 20 is inverted during application of the sealant 348, with the switch opening 192 being elevated above a circumferential opening 350. It is noted that respective lead wires 240,24 (only one of which is shown) protrude through the switch opening 192. Respective channels 188, 190 on opposing sides of the case 30 fluidly connect the switch opening 192 to the circumferential opening 350. With the illustrated design, liquid sealant 348 is supplied only to the switch opening 192 (see FIG. 16). In particular, the liquid sealant 348 is applied from the single source to the switch opening 192, thereby filling the switch opening 192 with sealant 348 at an established flow rate, which may be adjusted depending upon the sealant selected for use. For instance, various epoxies may have differing viscosities and cure times, requiring adjustment of the flow rate to the switch opening 192. Therefore, those of ordinary skill in the art will appreciate that a variety of flow rates may be selected and used to apply liquid sealant to the switch assembly.

Figure 17:
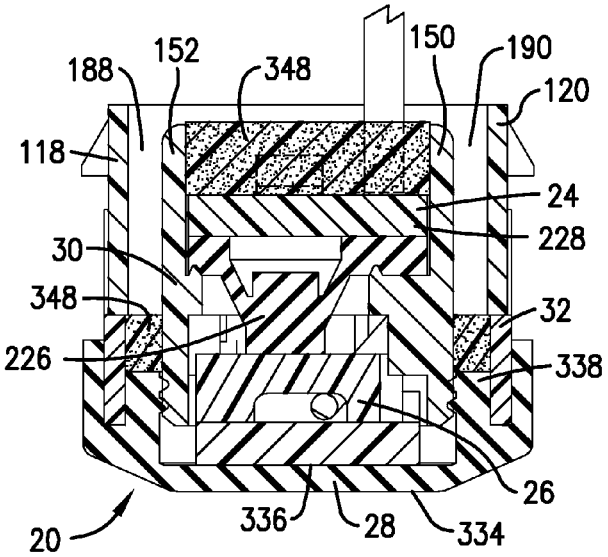
FIG. 17 is a sectional view of the switch assembly similar to FIGS. 15 and 16, but depicting sealant deposited in the switch and circumferential openings.

In any event, as the switch opening 192 is filled with liquid sealant 348, the liquid sealant 348 approaches the end (top) of the tapered upright wall portions 150,152. The contact board 228 serves as a floor for the switch opening 192, such that sealant 348 is contained between the board 228 and the inside surfaces 176,178 of the cross-walls 170,172 and the bottom wall portion 52 of the upright wall 48. Upon continued application of liquid sealant 348, the liquid sealant 348 will then flow over the wall portions 150,152 and begin to flow through the channels 188,190 by force of gravity. Thus, the overflow sealant is transferred to the lower circumferential 350 opening as illustrated in FIG. 17 by virtue of the overflow of liquid sealant 348 continuously applied to the switch opening 192. It is also noted that the floor of the circumferential opening 350 is defined by the end of the bead wall 338 of the pad 28. Therefore, sealant 348 is contained between the outer wall surface, the inside surface 206 of the latching ring wall 200, and the bead wall 338 of the pad 28. Sealant 348 is supplied to the switch opening 192 until the circumferential opening 350 and the switch opening 192 both have an amount of liquid sealant 348 sufficient to waterproof the switch assembly 20. In this manner, the liquid sealant 348 is applied by a single liquid sealant applicator.

Those of ordinary skill in the art will immediately recognize that the housing 22 and liquid sealant 348 arrangement may be variously configured and still be within the ambit of the present invention. For instance, the openings requiring sealant may number in excess of two, and the channels providing fluid transfer between various openings may be more or less numerous than the two channels illustrated herein. It is also not necessary for one opening to be higher than another so that gravity is designed to effect liquid sealant flow from one opening to another. For example, the switch assembly 20 could alternatively be designed to house a closed channel so that the sealant 348 is pumped under pressure through the channel and into the second opening.

The switch assembly 20 is preferably retained inverted within the switch compartment 174 while the sealant 348 sets or cures. The sealant's exposure within the openings to ambient conditions tends to reduce the time in which it takes for the sealant 348 to cure. It is also noted that the preferred sealant 348 material is preferably a liquid epoxy and is electrically insulating. Those of ordinary skill in the art will appreciate, however, that other suitable sealants may be used. However, it is critical for sealants to have suitable viscosity to flow through the channels 188,190 and to the second downstream opening, here the circumferential opening 350, prior to setting or curing.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention. Accordingly, the scope of the present invention will be limited only by the claims appended herein.

The inventors hereby state their intent to rely on the Doctrine of Equivalents to determine and assess the reasonably fair scope of the present invention as pertains to any apparatus not materially departing from but outside the literal scope of the invention as set forth in the following claims.

We claim:

1. A manually operated switch assembly comprising:

a housing;

a switch mechanism housed within the housing and configured to open or close a circuit upon actuation; and an actuator assembly shiftably supported relative to the housing, said actuator assembly including a depressible actuator configured to be manually depressed when the switch assembly is operated, said actuator presenting an actuator length and serving to actuate the switch mechanism when depressed, said actuator assembly including a stability element configured to ensure that the actuator moves substantially uniformly along the actuator length when depressed, such that actuation of the switch mechanism is facilitated regardless of where the actuator is depressed along the actuator length, said stability element being pivotally anchored to the housing at a pivot location, said stability element including an engagement portion that is spaced from the pivot location, such that the engagement portion moves along a generally arcuate path as the stability element pivots, said engagement portion engaging the actuator when the actuator is depressed so as to restrict actuator movement as the engagement portion is thereby caused to move along the generally arcuate path.

2. The manually operated switch assembly as claimed in claim 1, said actuator moving along a generally linear direction, when the actuator is depressed, to thereby cause the engagement portion to move along the generally arcuate path.

3. The manually operated switch assembly as claimed in claim 2, said actuator defining a channel that extends at least substantially transversely relative to the generally linear direction, said engagement portion being at least partly captured within the channel so as to slide along the channel as the actuator moves along the generally linear direction and the engagement portion moves along the generally arcuate path.

4. The manually operated switch assembly as claimed in claim 3, said actuator including an actuator body and an actuator cap that cooperatively define the channel, said stability element having a generally U-shaped configuration with a pair of spaced apart end prongs and a bight extending between the end prongs, said bight defining the engagement portion, said end prongs being coupled to the housing and extending along a common pivot axis to define the pivot location.

5. The manually operated switch assembly as claimed in claim 2, said actuator and housing being slidably coupled so that actuator slides relative to the housing when moving in the generally linear direction.

6. The manually operated switch assembly as claimed in claim 1, said switch mechanism presenting a switch length that is less than the actuator length, said stability element presenting an element length that is more than half the actuator length.

7. The manually operated switch assembly as claimed in claim 6, said element length being more than three-quarter the actuator length.

8. The manually operated switch assembly as claimed in claim 1, said housing presenting an open end through which the actuator is accessed; and a flexible pad sealingly overlying the open end of the housing.

9. The manually operated switch assembly as claimed in claim 1, said switch mechanism including a single switch, said switch mechanism presenting a switch length that is less than the actuator length, said switch mechanism being spaced generally equally between ends of the actuator.

10. The manually operated switch assembly as claimed in claim 9, said switch mechanism comprising a rubber dome switch that includes a flexible dome, with the dome being flexed by the actuator when the actuator is depressed, said switch mechanism including contact board defining a portion of the circuit, with the dome being configured to engage the board when flexed by the actuator.

11. A manually operated switch assembly comprising:

a housing;

a switch mechanism housed within the housing and configured to open or close a circuit upon actuation; and an actuator assembly shiftably supported relative to the housing, said actuator assembly including a depressible actuator configured to be manually depressed when the switch assembly is operated, said actuator presenting an actuator length and serving to actuate the switch mechanism when depressed, said actuator assembly including a stability element configured to ensure that the actuator moves substantially uniformly along the actuator length when depressed, such that actuation of the switch mechanism is facilitated regardless of where the actuator is depressed along the actuator length, said housing presenting a first opening configured to receive liquid sealant, said housing presenting a second opening spaced from the first opening, said housing defining a sealant transfer channel extending between the first and second openings to define a liquid sealant flow path therebetween, with the second opening being fluidly downstream from first opening, such that the transfer channel directs liquid sealant supplied to the first opening to the second opening, said first and second openings containing cured sealant, with the sealant in the second opening having been supplied from the first opening.

* * * * *